US005416886A

United States Patent [19]

Zahler

[11] Patent Number: 5,416,886

[45] Date of Patent: May 16, 1995

[54] PORTABLE CHAIN DRYING APPARATUS

[76] Inventor: Paul C. Zahler, 119 Abbey Peak La., Incline Village, Nev. 89452

[21] Appl. No.: 82,715

[22] Filed: Jun. 28, 1993

[51] Int. Cl.[6] ..... H05B 3/00; F27D 7/04

[52] U.S. Cl. ..... 392/382; 219/386; 219/400; 219/521

[58] Field of Search ..... 219/400, 521, 385, 386; 392/382, 360–369

[56] References Cited

U.S. PATENT DOCUMENTS

| | | | |
|---|---|---|---|
| 1,886,286 | 11/1932 | Martin | 219/400 |
| 1,962,982 | 6/1934 | Calkins | 219/400 |
| 2,098,295 | 11/1937 | Kettering | 219/400 |
| 2,221,045 | 11/1940 | Edington | 219/400 |
| 2,302,860 | 11/1942 | Hill | 219/400 |
| 3,686,774 | 8/1972 | Beadle | 219/400 |
| 3,985,102 | 10/1976 | Yonezawa | 219/400 |
| 3,997,978 | 12/1976 | Stuckey | 219/521 |
| 4,350,874 | 9/1982 | Nishikawa | 219/400 |
| 5,165,328 | 11/1992 | Erickson | 219/400 |

*Primary Examiner*—Teresa J. Walberg

*Attorney, Agent, or Firm*—Thomas I. Rozsa; Tony D. Chen

[57] ABSTRACT

A portable chain drying apparatus for drying or warming snow chains after they are used so that all the moisture is dried off from the snow chains and they will not rust. The portable chain drying apparatus includes a drying assembly which has a motor element, a heater element and a blower element. The snow chains are placed within the container and wrapped around in a coil fashion so that the heating and air drying elements are placed within the center of the container. The portable chain drying apparatus is powered by a 12-volt car battery and its power cord is designed to be adapted to a cigarette lighter of the vehicle.

27 Claims, 2 Drawing Sheets

PORTABLE CHAIN DRYING APPARATUS

BACKGROUND OF THE INVENTION

1. Field of The Invention

The present invention relates to the field of heating devices. In particular, the present invention is a portable chain drying apparatus for drying or warming snow chains.

2. Description of The Prior Art

Many people who drive in snow weather conditions are often required to have chains for their vehicle's tires. After the chains are used and removed from the vehicle, they are usually very wet because of the snow and slush. People usually remove the chains and store them in the trunk of the vehicle or place them back in the original container. Since the chains are still wet, they clearly rust within a matter of a few days or weeks and by the time they are to be subsequently used, the chains are frequently rusted. The rusted chains are very difficult to install and are frequently replaced with new snow chains. This is not practical.

The following prior art references are relevant to the field of the present invention.

1. U.S. Pat. No. 2,790,888 issued to Hoffmann on Apr. 30, 1957 for "Apparatus For Heating And Moistening Air For Food Carts" (hereafter "the Hoffmann Patent").

2. U.S. Pat. No. 3,239,949 issued to Miles on Mar. 15, 1966 for "Drying Cabinet" (hereafter "the Miles Patent").

3. U.S. Pat. No. 3,577,650 issued to Brahm on May 4, 1971 for "Portable And Collapsible Clothes Drier Receptacle" (hereafter "the Brahm Patent").

4. U.S. Pat. No. 3,985,102 issued to Yonezawa on Oct. 12, 1976 for "Dryer Apparatus For Hairs Of Pet Dogs" (hereafter "the Yonezawa Patent").

5. U.S. Pat. No. 4,549,072 issued to Brist et al. on Oct. 22, 1985 for "Proofing Or Heating Cabinet" (hereafter "the Brist Patent").

6. U.S. Pat. No. 4,559,903 issued to Bloom et al. on Dec. 24, 1985 for "Pet Dryer" (hereafter "the Bloom Patent").

7. U.S. Pat. No. 4,918,290 issued to DeMars on Apr. 17, 1990 for "Portable Towel Heating Device" (hereafter "the DeMars Patent").

8. U.S. Pat. No. 5,159,177 issued to Kinberger on Oct. 27, 1992 for "Container For Transporting Hot Ready-To-Eat Meals And Keeping Them Hot" (hereafter "the Kinberger Patent").

The DeMars Patent discloses a portable towel heating device. It includes a cabinet with two compartments. The upper compartment of the cabinet includes a support member for supporting a towel and the lower compartment includes a blower for generating a flow of heated air. The hot air is deflected by a deflector through the supporting member and through the towel.

The Yonezawa Patent discloses a dryer apparatus for drying the hair of pet dogs. It includes a box comprising transparent glass sidewalls with an upper compartment and a lower compartment. The front side of the box is an openable door. A plurality of apertures are provided in the central portion of the door so that the nose of a dog Can project outward. The lower compartment is for retaining the dog and the upper compartment is for retaining the dryer apparatus. The dryer apparatus is attached to an inner plate and below the dryer apparatus is a wire net so that the dog hairs do not fall onto the dryer apparatus.

The Bloom Patent discloses a pet dryer. It includes an inner shell spaced within an outer shell. A blower is provided and receives outside air from an inlet plenum defined between the shells. The blower discharges the air past a heater to a discharge plenum also defined between the shells. An aperture allows the heated air from the discharge plenum into the inner shell for drying the pet.

The Miles Patent discloses a drying cabinet. It includes a cabinet and a drying chamber which is assembled within the cabinet. The drying chamber includes trays which are slidably received within the chamber.

The Brahm Patent discloses a portable and collapsible clothes drier receptacle mounted on a foldable frame and attached to a heater-blower unit.

The Hoffmann Patent discloses an apparatus for heating and moistening air for food carts.

The Brist Patent discloses a proofing or heating cabinet.

The Kinberger Patent discloses a container for transporting hot ready-to-eat meals.

None of the prior art drying apparatus are suitable for drying or warming snow chains. Most of the drying apparatuses are utilized for drying pets such as a dog or keeping food warm.

Therefore, there is a need for a portable chain drying apparatus which can dry the snow chains immediately after use, so that the snow chains will not rust, and which can also be used to warm the snow chains prior to installing the snow chains. In addition, the snow chains can easily be reused again and again without costly replacement the snow chains.

SUMMARY OF THE INVENTION

The present invention is a portable chain drying apparatus for drying or warming snow chains after they are used so that all the moisture is dried off from the snow chains and they will not rust. The present invention is also used for warming snow chains before they are used so they are easier to handle on a cold day.

The present invention consists of a rectangular container which has a motor element, a blower element and a heater element. The snow chains are disposed within the container and wrapped around in a coil fashion, where the heating and air drying elements are placed within the center of the container. The container has a lid which is snapped onto the container, and hot air can be vented through the lid.

The present invention is powered by a 12-volt car battery with the power cord designed to be adapted to a cigarette lighter of the vehicle. The user merely plugs the power connector into the cigarette lighter and the hot air blows all around the interior of the enclosed container to dry or warm the snow chains.

The present invention portable chain drying apparatus can also be utilized for warming the snow chains prior to installation of the chains to the tires of the vehicle. The snow chains are frequently cold and people can suffer frostbite while installing the chains. Immediately prior to use, the present invention portable chain drying apparatus can be plugged in again to warm up the snow chains so that they are warmed up so that the chains are more easily applied to the tires of the vehicle.

The central element can be a conventional heater with small openings in the bottom so that the heat can be circulated in a generally circular fashion all around the entire interior of the container. By having the blower blow in this fashion, all of the chain areas within the container can be warmed and dried.

It has been discovered, according to the present invention, that if a portable chain drying apparatus has a cylindrical air circulating device integrally molded to the base of the container with a multiplicity of small apertures, it will provide means for the heated air to enter into the chamber of the container and to flow in a circular manner.

It has additionally been discovered, according to the present invention, that if the drying means is removably attachable, it will provide means to easily replace the drying means when it malfunctions.

It has further been discovered, according to the present invention, that if the portable chain drying apparatus has a power cord which is adapted to a vehicle cigarette lighter, it will provide means for the portable chain drying apparatus to be powered by the vehicle's battery.

It is therefore an object of the present invention to provide a portable chain drying apparatus.

It is also an object of the present invention to provide a portable chain drying apparatus which can dry all the moisture off the snow chains, so that the snow chains will not rust after use.

It is another object of the present invention to provide a portable chain drying apparatus which can warm up snow chains, so that the snow chains are easily installed to the tires of a vehicle.

It is an additional object of the present invention to provide a cylindrical air circulating device with a multiplicity of small apertures for the heated air to enter into the chamber of the container, so that the heated air can be circulated in a circular manner all around the entire interior of the container and all of the chain areas can be warmed and dried.

It is a further object of the present invention to provide the portable chain drying apparatus with a power cord which is adapted to a cigarette lighter of a vehicle, so that no other power source is required.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
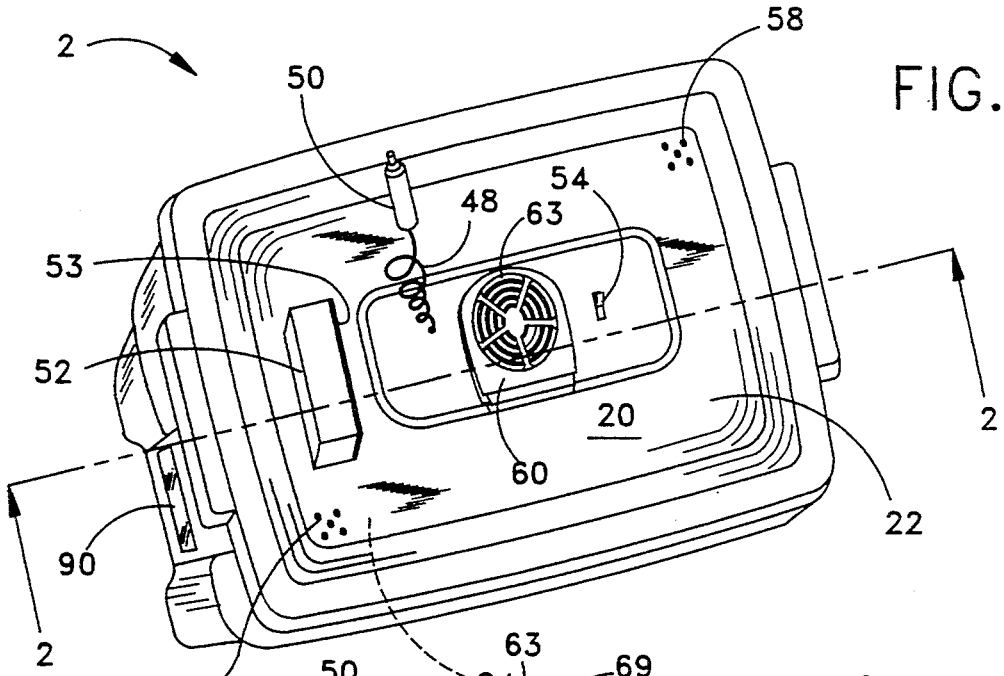
FIG. 1 is a perspective view of the preferred embodiment of the present invention portable chain drying apparatus.

Referring to FIG. 1, there is shown a portable chain drying apparatus 2 for drying or warming snow chains. The present invention can be utilized to prevent rust from developing on the snow chains after use. The present invention can also be utilized to warm the snow chains prior to installing the snow chains onto the tires of a vehicle. It is emphasized that while the present invention is for drying or warming snow chains, it is also within the spirit and scope of the present invention to keep articles warm such as food or beverages.

Figure 2:
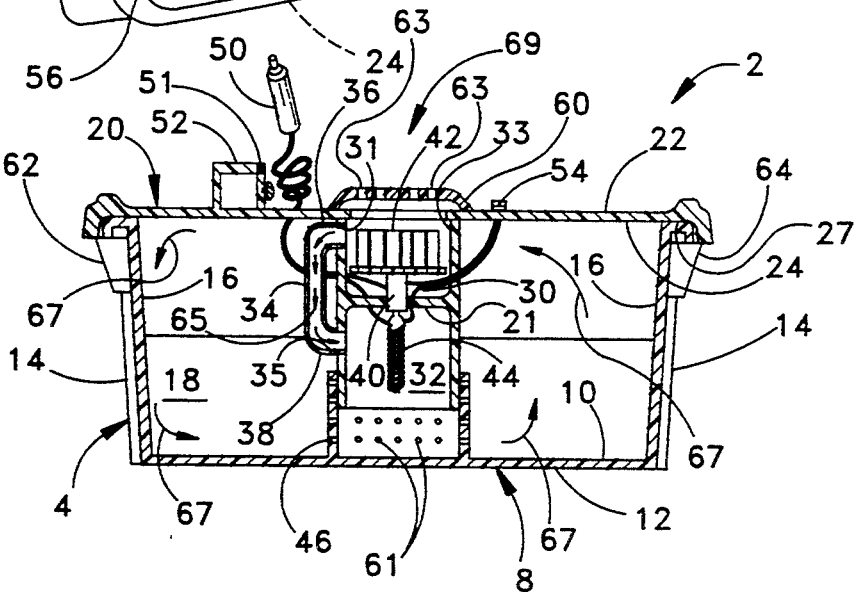
FIG. 2 is a cross-sectional view taken along line 2—2 of FIG. 1.
Figure 3:
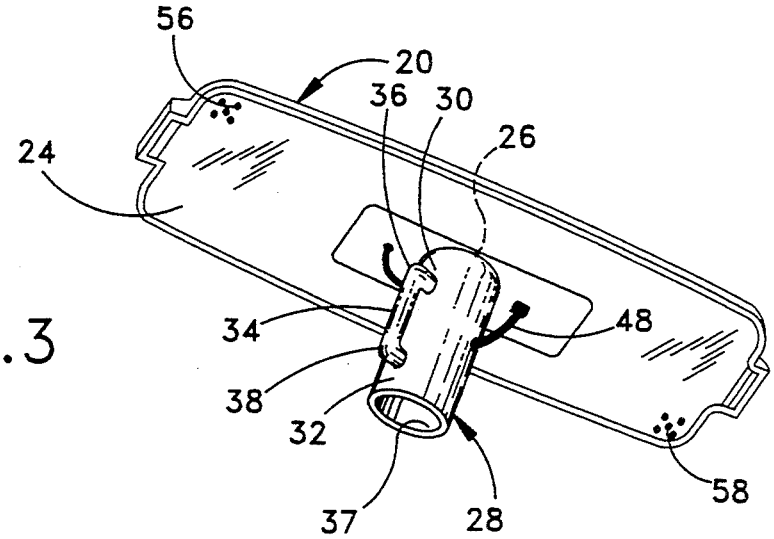
FIG. 3 is a bottom perspective view of the lid and the drying assembly.

Referring to FIGS. 1, 2 and 3, there is shown the portable chain drying apparatus 2 which includes a generally rectangular container 4 comprising a base 8 with an upper surface 10 and a lower surface 12. The container 4 further comprises four sidewalls with exterior surfaces 14 and interior surfaces 16 which together with the upper surface 10 of the base 8 defines an interior chamber 18 for receiving the snow chains. To carry the portable chain apparatus 2 around, two handles 62, 64 are provided. The two handles 62, 64 are integrally molded to the exterior surfaces 14 of the four sidewalls at opposite locations.

A removably attachable lid 20 includes an upper surface 22, a lower surface 24 and a central opening 26. The lid 20 can be secured by snapping the lid 20 onto the upper rim 27 and completely covering the container 4. The removably attachable lid 20 also has two groups of vent openings 56, 58 which are located diagonally to each other for allowing the heated air to escape from the interior chamber 18 of the container 4. Although the removably attachable lid 20 has two groups of vent openings 56, 58, it is also within the spirit and scope of the present invention to have a multiplicity of vent openings incorporated into the portable chain drying apparatus 2.

FIG. 2 is a cross-sectional view of the portable chain drying apparatus 2. A drying assembly 28 has a generally cylindrical hollow body with a partition 21 that separates an upper chamber 30 and a lower chamber 32. The upper chamber 30 includes an upper portion with a top opening 33 and a side opening 31, and the lower chamber 32 includes a bottom portion with a bottom opening 37 and a side opening 35. The cylindrical hollow body is integrally mounted to the lower surface 24 of the removably attachable lid 20 by aligning the top opening 33 of the upper chamber 30 with the central opening 26 of the removably attachable lid 20 for allowing outside air to flow therethrough.

An elongated air flow tunnel 34 which is shaped like a "C" or "U" comprises a top end 36 and a bottom end 38. The top end 36 is integrally mounted to the side opening 31 of the upper chamber 30. The bottom end 38 is integrally mounted to the side opening 35 of the lower chamber 32 for allowing the outside air to flow from the upper chamber 30 to the lower chamber 32. Arrows 65 are provided within the air flow tunnel 34 to show the direction of air flow.

A motor means 40 and a blower or fan means 42 are both disposed within the upper chamber 30 of the drying assembly 28. The motor means 40 propels the blower means 42 which receives and discharges the outside air to the elongated air flow tunnel 34. To heat the air supplied to the lower chamber 32 heating means is provided. A heater means 44 is disposed within the lower chamber 32 of the drying assembly 28 for heating the outside air. The cool outside air is drawn in through the top opening 33 of the upper chamber 30 by the blower means 42 and travels through the air flow tunnel 34 and past the heater means 44 where it is heated to a temperature of approximately 80° -90° F.

A thermostat (not shown) may be utilized with the present invention. The thermostat senses the temperature of the heated air and automatically shuts off the portable drying chain apparatus 2 if the temperature inside the interior chamber 18 becomes to hot, in the range of 95° F. to 105° F. A timer (not shown) may also be utilized in connection with the present invention.

An air circulating device 46 is integrally molded to the upper surface 10 of the base 8 and is located in the center of the container 4. The air circulating device 46 is generally a hollow cylindrical body that extends upwardly to a middle section of the container 4. The air circulating device 46 includes a circumferential sidewall with a multiplicity of small apertures 61 for allowing heated air to flow out to the interior chamber 18 of the container 4. Arrows 67 are provided to show the direction of the heated air is circulating. The air circulating device 46 also has a top opening substantially wide enough for receiving the bottom portion of the lower chamber 32. When the removably attachable lid 20 is fastened to the container 4, the bottom portion of the lower chamber 32 extends downwardly into the interior chamber 18 and is mated with the top opening of the air circulating device 46.

A power cord 48 which is designed like a coil has one end connected to a connector 50 and an opposite end connected to the drying assembly 28 for connecting electrical power to the motor means 40 and the heater means 44. The connector 50 is adapted to a cigarette lighter of a vehicle. Although the drying assembly 28 is powered by the battery of the vehicle, it is appreciated that the present invention can be powered by any suitable means.

A small compartment 52 is integrally formed on the upper surface 22 of the removably attachable lid 20 at a location adjacent to the central opening 26. The small compartment 52 includes an access door 53 which is secured by hinge 51 to the small compartment 52 and can only be opened from the upper surface 22 of the removable attachable lid 20. The small compartment 52 is used for storing the connector 50 and the power cord 48 when not in use.

To operate the portable chain drying apparatus 2 an ON/OFF rocker switch 54 is provided and is mounted onto the upper surface 22 of the removably attachable lid 20 at a location adjacent to the central opening 26. The rocker switch 54 is electrically connected with the drying assembly 28 for activating or deactivating the portable chain drying apparatus 2. Electrical power is provided through the power cord 48 for connecting electrical power to the motor means 40 and the heater means 44.

An inlet cover 60 is integrally mounted to the top surface 22 of the removably attachable lid 20 and completely shields the central opening 26. The inlet cover 60 has small slot openings 63 for allowing outside air to enter into the drying assembly 28. The inlet cover 60 is also utilized to shield the blower element 42 from falling debris. Arrow 69 is provided to show the direction in which the outside air is flowing.

The portable chain drying apparatus 2 further comprises safety reflectors affixed to the exterior surfaces 14 of the four sidewalls by adhesive means or other suitable means. One such reflector 90 is shown in FIG. 1. These safety reflectors are utilized for preventing accidents from occurring when someone stops the side of the road to install the snow chains. The oncoming vehicle will be able to see the reflected safety reflectors on the portable chain drying apparatus 2, so that the oncoming vehicle will avoid hitting the parked vehicle.

In operation, the snow chains are placed within the interior chamber 18 of the container 4 and wrapped around in a coil fashion so that the heating and air drying elements are placed within the center of the container 4. The removably attachable lid 20 is closed onto the container 4, and the connector 50 is connected to the cigarette lighter. The rocker switch 54 is positioned to the on condition, and the snow chains can be dried or warmed by the drying assembly 28.

The portable chain drying apparatus 2 can be made from several materials. The manufacturing process which could accommodate the construction of the portable chain drying apparatus 2 may be injection, thermoform, etc. or other molding process. The molding and mass production process would enable the portable chain drying apparatus 2 to be produced inexpensively.

Figure 4:
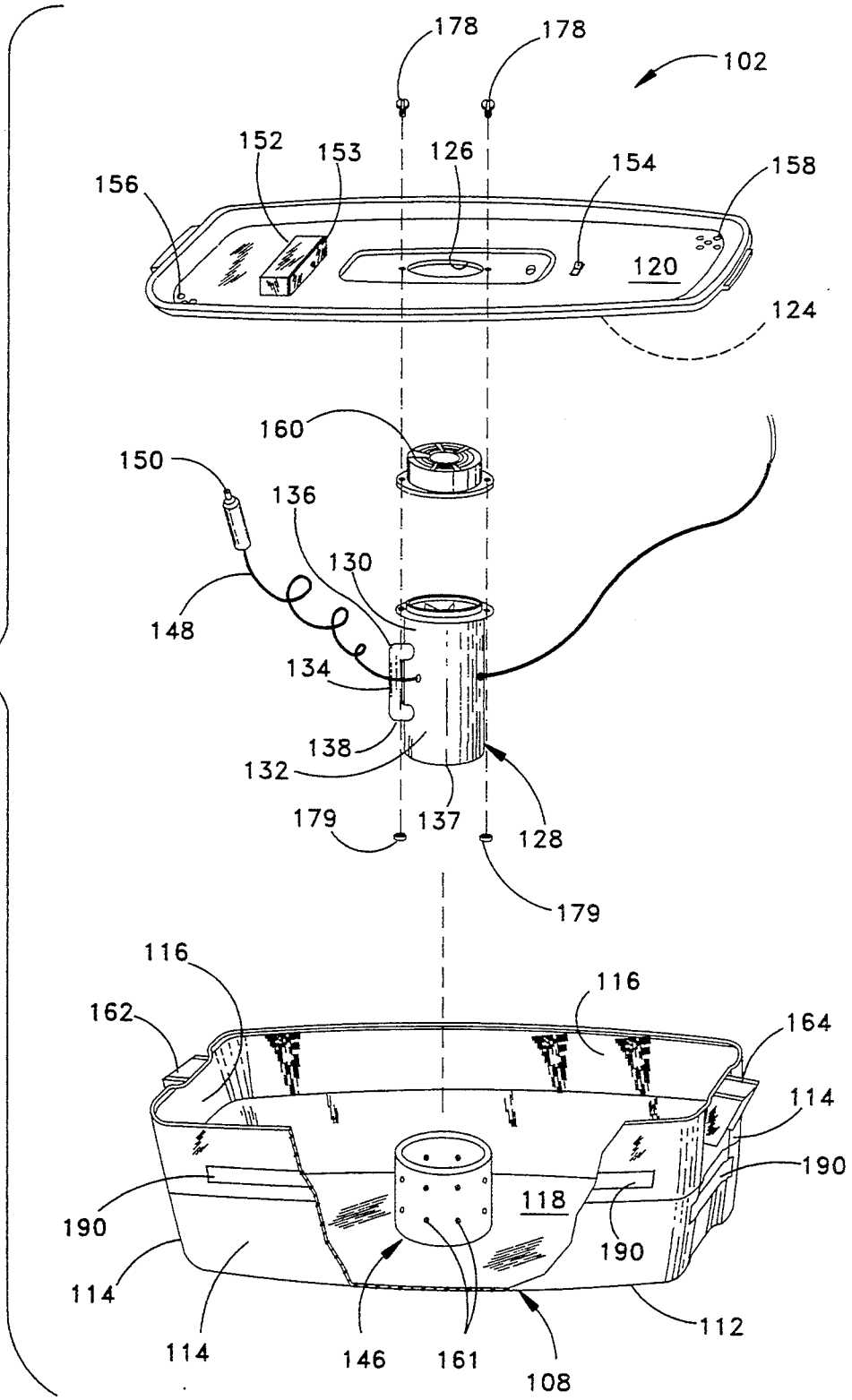
FIG. 4 is an exploded view of an alternative embodiment of the present invention portable chain drying apparatus and a partial cut view of the container.

Referring to FIG. 4, there is shown an alternative embodiment 102 of the present invention portable chain drying apparatus. Since it functions the same as previously described above in FIGS. 1 through 3, except that the drying assembly 128 is assembled differently than the preferred embodiment, the parts are numbered correspondingly with 100 added to each number.

An inlet cover 160 is now mounted on the lower surface 124 of the removably attachable lid 120 by two elongated screw means 178 and two corresponding nut means 179. The drying assembly 128 is mounted to the inlet cover 160 by the same screws 178 and the nuts 179. By utilizing this method, the replacement cost is now reduced. The manufacturer only has to replace the drying assembly 128 if it is malfunctioning instead of the whole apparatus 102.

The present invention has many advantageous features including: (a) an apparatus which is portable; (b) a power source which is adapted to the cigarette lighter of the vehicle; and (c) the portable chain drying apparatus can be utilized to keep food or beverages warm; and (d) it is inexpensive to manufacture.

Defined in detail, the present invention is a portable chain drying apparatus for drying or warming snow chains, the apparatus comprising: (a) a generally rectangular container having four sidewalls and a base with an upper surface and a lower surface, the four sidewalls having exterior surfaces and interior surfaces which together with the upper surface of the base defines an interior chamber for receiving said snow chains; (b) a removably attachable lid having an upper surface, a lower surface and a central opening, where the removably attachable lid covers said container; (c) a drying assembly having a cylindrical hollow body with a partition that separates an upper chamber and a lower chamber, the upper chamber having an upper portion with a top opening and a side opening, the lower chamber having a bottom portion with a bottom opening and a side opening, and the cylindrical hollow body integrally mounted to said lower surface of said removably attachable lid by aligning said top opening of said upper chamber with said central opening of said removably attachable lid for allowing outside air to flow therethrough; (d) an elongated air flow tunnel having a top end and a bottom end, the top end integrally mounted to said side opening of said upper chamber, and the bottom end integrally mounted to said side opening of said lower chamber for allowing said outside air to flow from said upper chamber to said lower chamber; (e) a motor element for driving a blower element, both disposed within said upper chamber of said drying assembly, the blower element receives and discharges said outside air into said elongated air flow tunnel; (f) a heater element disposed within said lower chamber of said drying assembly, where said outside air passes the heater element which heats said outside air; (g) an air circulating device integrally molded to said upper surface of said base at a central location and having a generally hollow cylindrical body which extends upwardly to a middle section of said container, the cylindrical body having a circumferential sidewall with a multiplicity of small apertures for allowing heated air to flow through to said interior chamber of said container, and further having a top opening substantially wide enough for receiving said bottom portion of said lower chamber; (h) a power cord having one end connected to a connector and an opposite end connected to said drying assembly for connecting electrical power to said motor element and to said heater element; (i) a small compartment integrally formed on said upper surface of said removably attachable lid at a location adjacent to said central opening for storing said connector and said power cord; (j) a rocker switch mounted on said upper surface of said removably attachable lid at a location adjacent to said central opening, the rocker switch electrically connected with said power cord and having an ON/OFF function for activating or deactivating said drying assembly; (k) said removably attachable lid having two groups of vent openings located diagonally to each other for allowing said heated air to escape from said interior chamber of said container; (I) an inlet cover having slot openings, the inlet cover integrally mounted to said upper surface of said removably attachable lid for completely shielding said central opening; and (m) two handles with a respective one handle integrally molded to opposite exterior surfaces of said container sidewalls and at locations adjacent to said removably attachable lid; (n) whereby by placing said snow chains into said interior chamber of said container, and closing said container with said removably attachable lid and switching on said rocker switch, said snow chains can be dried or warmed by said drying assembly and said snow chains will not rust.

Defined broadly, the present invention is a portable chain drying apparatus for drying or warming tire chains, the apparatus comprising: (a) a container having at least one sidewall and a base with an upper surface and a lower surface, the at least one sidewall having an exterior surface and an interior surface, the interior surface together with the upper surface of the base defining a chamber for receiving said tire chains; (b) a lid having an upper surface, a lower surface and an opening, where the lid covers said container; (c) a drying assembly having an upper chamber and a lower chamber, the upper chamber having a side opening and a top opening, the lower chamber having a side opening and a bottom opening, and the drying assembly integrally mounted to said lower surface of said lid by aligning said top opening of said upper chamber with said opening of said lid for allowing outside air to flow therethrough; (d) a tunnel having one end integrally mounted to said side opening of said upper chamber and an opposite end integrally mounted to said side opening of said lower chamber for allowing said outside air to flow from said upper chamber to said lower chamber; (e) a motor means for driving a blower means, both disposed within said upper chamber of said drying assembly, and the blower means receives and discharges said outside air to said tunnel; (f) a heater means disposed within said lower chamber of said drying assembly, where said outside air passes the heater means which heats said outside air; (g) a circulating device integrally molded to said upper surface of said base at a central location and extending upwardly to a middle section of said container, the circulating device having a sidewall with a multiplicity of small apertures for allowing heated air to flow through to said chamber of said container, and further having an opening substantially wide enough for receiving said bottom opening of said lower chamber; (h) a power cord having one end connected to a connector and an opposite end connected to said drying assembly for connecting electrical power to said motor means and said heater means; and (i) means for activating or deactivating said drying assembly; (j) whereby by placing said tire chains into said chamber of said container, and closing said container with said lid, said tire chains can be dried or warmed by said drying assembly and said tire chains will not rust.

Defined more broadly, the present invention is a portable drying apparatus for drying or warming articles, the apparatus comprising: (a) a container having a circumferential sidewall and a base with an upper surface and a lower surface, the sidewall having an exterior surface and an interior surface which together with the upper surface of the base defines a chamber for receiving said articles, and a lid having an upper surface, a lower surface and an opening; (b) a drying assembly having a chamber with a top opening and a bottom opening, the drying assembly affixed to said lid; (c) a motor means, a fan means and a heater means disposed within said chamber of said drying assembly, the motor means propelling the fan means which receives and discharges outside air to said chamber, where the heater means heats the outside air; (d) means for allowing heated air to enter into said chamber of said container; and (e) means for electrically powering said motor means and said heater means; (f) whereby by placing said articles into said chamber of said container, and closing said container with said lid, said articles can be dried or warmed by said drying assembly.

Alternatively defined in detail, the present invention is a portable chain drying apparatus for drying or warming tire chains, the apparatus comprising: (a) a container having at least one sidewall and a base with an upper surface and a lower surface, the at least one sidewall having an exterior surface and interior surface, the interior surface together with the upper surface of the base defining a chamber for receiving said tire chains; (b) a lid having an upper surface, a lower surface and an opening, where the lid covers said container; (c) a drying assembly having an upper chamber and a lower chamber, the upper chamber having a side opening and a top opening, and the lower chamber having a side opening and a bottom opening; (d) means for affixing said drying assembly; (e) a tunnel having one end integrally mounted to said side opening of said upper chamber and an opposite end integrally mounted to said side opening of said lower chamber for allowing said outside air to flow from said upper chamber to said lower chamber; (f) a motor means for driving a blower means, both disposed within said upper chamber of said drying assembly, the blower means receives and discharges said outside air to said tunnel; (g) a heater means disposed within said lower chamber of said drying assembly, where said outside air passes the heater means which heats said outside air; (h) a circulating device integrally molded to said upper surface of said base at a central location and extending upwardly to a middle section of said container, the circulating device having a sidewall with a multiplicity of small apertures for allowing heated air to flow through to said chamber of said container, and further having an opening substantially wide enough for receiving said bottom opening of said lower chamber; (i) a power cord having one end connected to a connector and an opposite end connected to said drying assembly for connecting electrical power to said motor means and said heating means; (j) means for activating or deactivating said drying assembly; and (k) means for affixing an inlet cover to said lower surface of said lid; (l) whereby by placing said tire chains into said chamber of said container, and closing said container with said lid, said tire chains can be dried or warmed by said drying assembly and said tire chains will not rust.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A portable chain drying apparatus for drying or warming snow chains, the apparatus comprising:

a. a generally rectangular container having four sidewalls and a base with an upper surface and a lower surface, the four sidewalls having exterior surfaces and interior surfaces which together with the upper surface of the base defines an interior chamber for receiving snow chains;

b. a removably attachable lid having an upper surface, a lower surface and a central opening, where the removably attachable lid covers said container;

c. a drying assembly having a cylindrical hollow body with a partition that separates an upper chamber and a lower chamber, the upper chamber having an upper portion with a top opening and a side opening, the lower chamber having a bottom portion with a bottom opening and a side opening, and the cylindrical hollow body integrally mounted to said lower surface of said removably attachable lid by aligning said top opening of said upper chamber with said central opening of said removably attachable lid for allowing outside air to flow therethrough;

d. an elongated air flow tunnel having a top end and a bottom end, the top end integrally mounted to said side opening of said upper chamber, and the bottom end integrally mounted to said side opening of said lower chamber for allowing said outside air to flow from said upper chamber to said lower chamber;

e. a motor element for driving a blower element, both disposed within said upper chamber of said drying assembly, the blower element receives and discharges said outside air into said elongated air flow tunnel;

f. a heater element disposed within said lower chamber of said drying assembly, where said outside air passes the heater element which heats said outside air;

g. an air circulating device integrally molded to said upper surface of said base at a central location and having a generally hollow cylindrical body which extends upwardly to a middle section of said container, the cylindrical body having a circumferential sidewall with a multiplicity of small apertures for allowing heated air to flow through to said interior chamber of said container, and further having a top opening substantially wide enough for receiving said bottom portion of said lower chamber;

h. a power cord having one end connected to a connector and an opposite end connected to said drying assembly for connecting electrical power to said motor element and to said heater element;

i. a small compartment integrally formed on said upper surface of said removably attachable lid at a location adjacent to said central opening for storing said connector and said power cord;

j. a rocker switch mounted on said upper surface of said removably attachable lid at a location adjacent to said central opening, the rocker switch electrically connected with said power cord and having an ON/OFF function for activating or deactivating said drying assembly;

k. said removably attachable lid having two groups of vent openings located diagonally to each other for allowing said heated air to escape from said interior chamber of said container;

l. an inlet cover having slot openings, the inlet cover integrally mounted to said upper surface of said removably attachable lid for completely shielding said central opening; and m. two handles with a respective one handle integrally molded to opposite exterior surfaces of said container sidewalls and at locations adjacent to said removably attachable lid;

n. whereby by placing said snow chains into said interior chamber of said container, and closing said container with said removably attachable lid and switching on said rocker switch, said snow chains can be dried or warmed by said drying assembly and said snow chains will not rust.

2. The invention as defined in claim 1 further comprising safety reflectors which are located on said exterior surfaces of said four sidewalls of said container.

3. The invention as defined in claim 1 wherein said connector is adapted to a cigarette lighter of a vehicle.

4. The invention as defined in claim 1 wherein said small compartment further comprises a hingeably attached access door and is accessible from said upper surface of said removably attachable lid.

5. A portable chain drying apparatus for drying or warming tire chains, the apparatus comprising:

a. a container having at least one sidewall and a base with an upper surface and a lower surface, the at least one sidewall having an exterior surface and an interior surface, the interior surface together with the upper surface of the base defining a chamber for receiving tire chains;

b. a lid having an upper surface, a lower surface and an opening, where the lid covers said container;

c. a drying assembly having an upper chamber and a lower chamber, the upper chamber having a side opening and a top opening, the lower chamber having a side opening and a bottom opening, and the drying assembly integrally mounted to said lower surface of said lid by aligning said top opening of said upper chamber with said opening of said lid for allowing outside air to flow therethrough;

d. a tunnel having one end integrally mounted to said side opening of said upper chamber and an opposite end integrally mounted to said side opening of said lower chamber for allowing said outside air to flow from said upper chamber to said lower chamber;

e. a motor means for driving a blower means, both disposed within said upper chamber of said drying assembly, and the blower means receives and discharges said outside air to said tunnel;

f. a heater means disposed within said lower chamber of said drying assembly, where said outside air passes the heater means which heats said outside air;

g. a circulating device integrally molded to said upper surface of said base at a central location and extending upwardly to a middle section of said container, the circulating device having a sidewall with a multiplicity of small apertures for allowing heated air to flow through to said chamber of said container, and further having an opening substantially wide enough for receiving said bottom opening of said lower chamber;

h. a power cord having one end connected to a connector and an opposite end connected to said drying assembly for connecting electrical power to said motor means and said heater means; and i. means for activating or deactivating said drying assembly;

j. whereby by placing said tire chains into said chamber of said container, and closing said container with said lid, said tire chains can be dried or warmed by said drying assembly and said tire chains will not rust.

6. The invention as defined in claim 5 further comprising an inlet cover having slot opening for allowing outside air to enter into said drying assembly and integrally mounted to said upper surface of said lid for completely shielding said opening.

7. The invention as defined in claim 5 further comprising safety reflectors which are located on said exterior surface of said at least one sidewall of said container.

8. The invention as defined in claim 5 wherein said lid includes a multiplicity of group vent openings for allowing said heated air to escape from said chamber of said container.

9. The invention as defined in claim 5 wherein said connector is adapted to a cigarette lighter of a vehicle.

10. The invention as defined in claim 5 further comprising means for storing said connector and said power cord which is a small compartment integrally formed on said upper surface of said lid, and the small compartment has a hingeably attached access door.

11. The invention as defined in claim 5 wherein said means for activating or deactivating said drying assembly is a rocker switch electrical connected with said power cord and mounted on said upper surface of said lid at a location adjacent to said opening.

12. A portable drying apparatus for drying or warming articles, the apparatus comprising:

a. a container having a circumferential sidewall and a base with an upper surface and a lower surface, the sidewall having an exterior surface and an interior surface which together with the upper surface of the base defines a chamber for receiving articles, and a lid having an upper surface, a lower surface and an opening;

b. a drying assembly having a chamber with a top opening and a bottom opening, the drying assembly affixed to said lid;

c. a motor means, a fan means and a heater means disposed within said chamber of said drying assembly, the motor means propelling the fan means which receives and discharges outside air to said chamber, where the heater means heats the outside air;

d. an air circulating device attached to said upper surface of said base and extending upwardly to a middle section of said container and having a sidewall with a multiplicity of small apertures for allowing heated air to enter into said chamber of said container; and e. means for electrically powering said motor means and said heater means;

f. whereby by placing said articles into said chamber of said container, and closing said container with said lid, said articles can be dried or warmed by said drying assembly.

13. The invention as defined in claim 12 further comprising an inlet cover with slot openings and integrally mounted to said upper surface of said lid for completely shielding said opening.

14. The invention as defined in claim 12 further comprising safety reflectors which are located on said sidewall of said container.

15. The invention as defined in claim 12 further comprising a rocker switch for activating or deactivating said drying assembly.

16. The invention as defined in claim 12 further comprising two groups of vent openings on said lid for allowing said heated air to escape from said chamber of said container.

17. The invention as defined in claim 12 further comprising at least one handle integrally molded to at least one of said exterior surfaces of said sidewall of said container.

18. The invention as defined in claim 12 wherein said means for electrically powering said motor means and said heater means is a connector connected to a power cord, and the connector is adapted to a cigarette lighter of a vehicle.

19. The invention as defined in claim 18 further comprising a small compartment located on said upper surface of said lid and having an access door for storing said connector and said power cord.

20. A portable chain drying apparatus for drying or warming tire chains, the apparatus comprising:

a. a container having at least one sidewall and a base with an upper surface and a lower surface, the at least one sidewall having an exterior surface and interior surface, the interior surface together with the upper surface of the base defining a chamber for receiving tire chains;

b. a lid having an upper surface, a lower surface and an opening, where the lid covers said container;

c. a drying assembly having an upper chamber and a lower chamber, the upper chamber having a side opening and, a top opening, and the lower chamber having a side opening and a bottom opening;

d. means for affixing said drying assembly to said lower surface of said lid;

e. a tunnel having one end integrally mounted to said side opening of said upper chamber and an opposite end integrally mounted to said side opening of said lower chamber for allowing said outside air to flow from said upper chamber to said lower chamber;

f. a motor means for driving a blower means, both disposed within said upper chamber of said drying assembly, the blower means receives and discharges said outside air to said tunnel;

g. a heater means disposed within said lower chamber of said drying assembly, where said outside air passes the heater means which heats said outside air;

h. a circulating device integrally molded to said upper surface of said base at a central location and extending upwardly to a middle section of said container, the circulating device having a sidewall with a multiplicity of small apertures for allowing heated air to flow through to said chamber of said container, and further having an opening substantially wide enough for receiving said bottom opening of said lower chamber;

i. a power cord having one end connected to a connector and an opposite end connected to said drying assembly for connecting electrical power to said motor means and said heating means;

j. means for activating or deactivating said drying assembly; and k. means for affixing an inlet cover to said lower surface of said lid;

l. whereby by placing said tire chains into said chamber of said container, and closing said container with said lid, said tire chains can be dried or warmed by said drying assembly and said tire chains will not rust.

21. The invention as defined in claim 20 further comprising safety reflectors which are located on said exterior surface of at least one sidewall of said container.

22. The invention as defined in claim 20 wherein said lid has a multiplicity of vent openings for allowing said heated air to escape from said chamber of said container.

23. The invention as defined in claim 20 wherein said connector is adapted to a cigarette lighter of a vehicle.

24. The invention as defined in claim 20 further comprising means for storing said connector and said power cord which is a small compartment integrally formed on said upper surface of said lid, and the small compartment having a hingeably attached access door.

25. The invention as defined in claim 20 wherein said means for activating or deactivating said drying assembly is a rocker switch electrically connected with said power cord and mounted on said upper surface of said lid at a location adjacent to said opening.

26. The invention as defined in claim 20 wherein said means for means for affixing said inlet cover to said lower surface of said lid is by screw and nut means.

27. The invention as defined in claim 20 wherein said means for affixing said drying assembly is by screw and nut means.

* * * * *